US005582248A

United States Patent [19]

Estes

[11] Patent Number: 5,582,248

[45] Date of Patent: Dec. 10, 1996

[54] REVERSAL-RESISTANT APPARATUS FOR TOOL ORIENTATION IN A BOREHOLE

[75] Inventor: James D. Estes, Arlington, Tex.

[73] Assignee: Wedge Wireline, Inc., Grand Prairie, Tex.

[21] Appl. No.: 459,978

[22] Filed: Jun. 2, 1995

[51] Int. Cl.[6] ..... E21B 47/02; E21B 43/119

[52] U.S. Cl. ..... 166/255.2; 175/4.51; 324/339; 324/233

[58] Field of Search ..... 166/55.1, 255.1, 166/254.2, 254.1, 255.2; 175/4.51; 324/339, 233

[56] References Cited

U.S. PATENT DOCUMENTS

| | | | |
|---|---|---|---|
| 2,667,932 | 2/1954 | Bodine, Jr. | 166/20 |
| 2,680,485 | 6/1954 | Bodine, Jr. | 166/1 |
| 2,700,422 | 1/1955 | Bodine, Jr. | 166/9 |
| 2,768,684 | 10/1956 | Castel et al. | 164/5 |
| 3,019,841 | 2/1962 | Ternow | 155/55.1 |
| 3,097,693 | 7/1963 | Terrel | 166/255.2 |
| 3,165,153 | 1/1965 | Lanmon | 166/255.2 X |
| 3,175,608 | 3/1965 | Wilson | 166/4 |
| 3,294,163 | 12/1966 | Lebourg | 166/255.2 |
| 3,322,196 | 5/1967 | Bodine, Jr. | 166/45 |
| 3,342,275 | 9/1967 | Mellies | 175/4.51 |
| 3,426,849 | 2/1969 | Brumble, Jr. | 166/255.2 |
| 3,578,081 | 5/1971 | Bodine | 166/249 |
| 3,704,749 | 12/1972 | Estes et al. | 166/255 |
| 3,730,282 | 5/1973 | Chapman | 175/4.51 |
| 3,776,323 | 12/1973 | Spidell et al. | 175/4.51 |
| 3,815,677 | 6/1974 | Pennebaker, Jr. | 166/253 |
| 3,942,373 | 3/1976 | Rogers | 73/151 |
| 3,964,553 | 6/1976 | Basham et al. | 175/4.51 |
| 4,153,118 | 5/1979 | Hart | 175/4.51 |
| 4,244,424 | 1/1981 | Talbot | 166/66 |
| 4,434,654 | 3/1984 | Hulsing, II et al. | 73/151 |
| 4,515,010 | 5/1985 | Weido et al. | 73/151 |
| 4,572,293 | 2/1986 | Wilson et al. | 166/250 |
| 4,708,204 | 11/1987 | Stroud | 166/255 |
| 4,744,416 | 5/1988 | Bower | 166/253 |
| 4,794,336 | 12/1988 | Marlow et al. | 324/221 |
| 4,964,462 | 10/1990 | Smith | 166/255 |
| 5,105,894 | 4/1992 | Enderlin | 166/255.2 |
| 5,351,755 | 10/1994 | Howlett | 166/255.2 |

*Primary Examiner*—Frank Tsay
*Attorney, Agent, or Firm*—Richards, Medlock & Andrews

[57] ABSTRACT

An orienting device for a perforator or the like to permit directing the tool at a selected angle relative to a ferrous element such as an adjacent casing string, and further an orienting device which is resistant to signal reversal resulting from ferrous non-uniformities in the region of the wellbore, the orienting device comprising an electromagnetic field source producing an alternating electromagnetic field and a receiver array longitudinally spaced from the electromagnetic field source, the disposition of the receiver array being such that the voltages induced therein vary differentially with the angle presented by the proximate ferrous elements by reason of the distortion of the otherwise axially symmetrical field. Electronic circuitry is provided to convert the differential voltages to a signal which is received at the surface and caused to register the orientation angle. A motor section is provided to rotate the device. All operating power, control signals, and information signals are transmitted by a single conductor cable serving also to suspend the device.

28 Claims, 5 Drawing Sheets

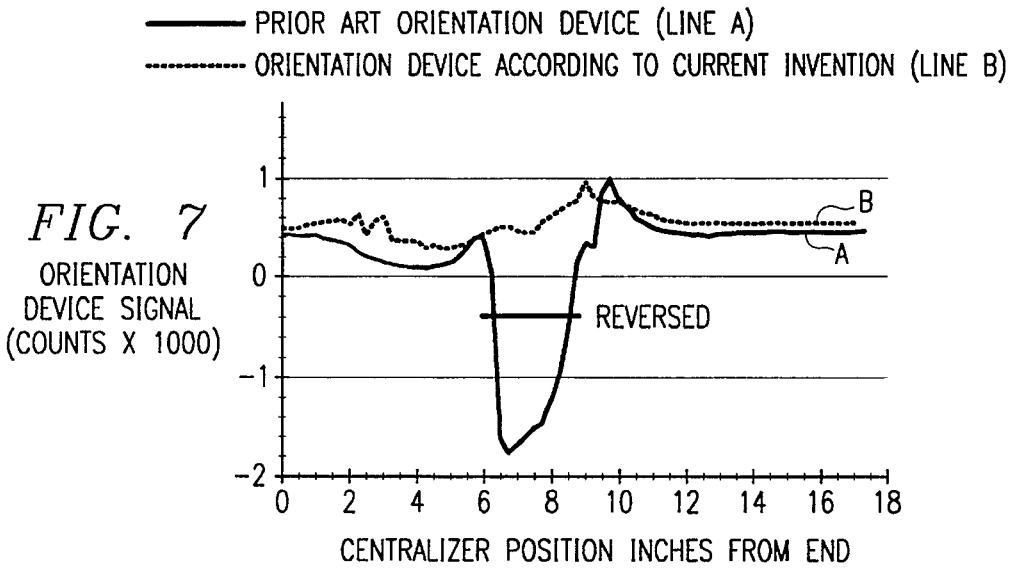
FIG. 8a
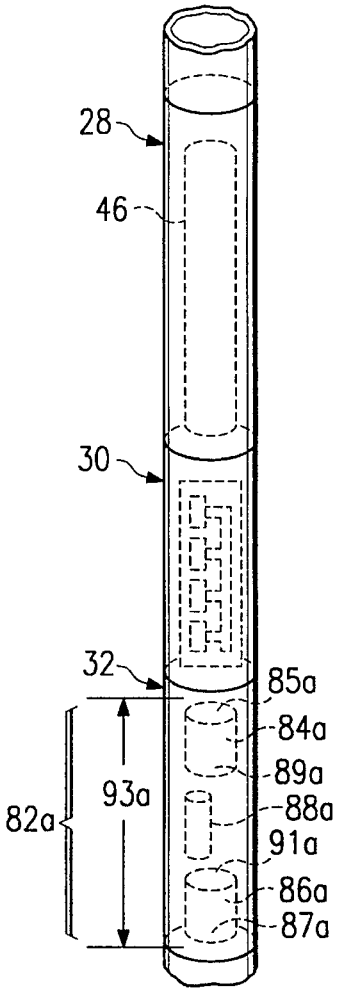
FIG. 8b
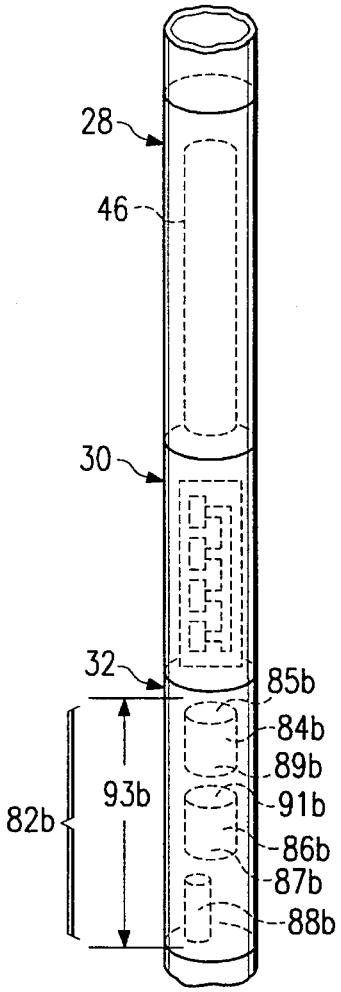
FIG. 8c
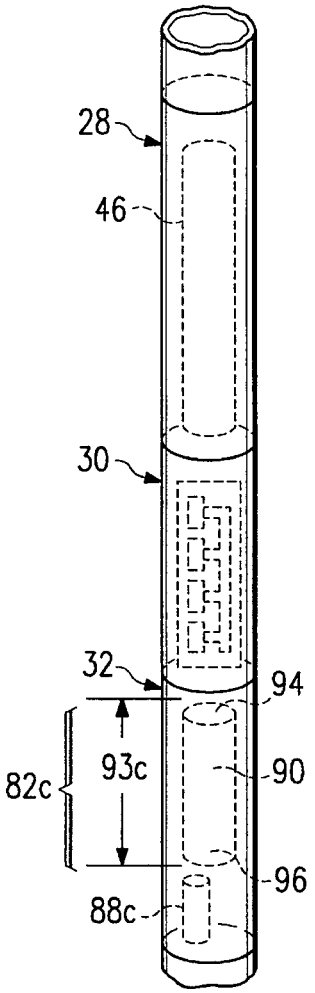

REVERSAL-RESISTANT APPARATUS FOR TOOL ORIENTATION IN A BOREHOLE

TECHNICAL FIELD OF THE INVENTION

This invention relates to an apparatus and method for orienting a directional tool, such as a perforator, in a borehole, such as an oil or gas well, and more particularly in a well bore which contains two or more casing strings in a side-by-side relationship.

BACKGROUND OF THE INVENTION

For many "downhole" operations, i.e., those operations carried out by means of tools lowered into boreholes, it is necessary to be able to determine the orientation of the tool when it is emplaced at the selected depth. Downhole tools are frequently lowered into the borehole on a single cable, or "wireline", and during the course of lowering the tool, may rotate unpredictably such that its orientation can no longer be determined with certainty from the surface.

The need to determine downhole tool orientation is particularly acute in the case of a "multiple zone completion", i.e., where an oil or gas well is completed so as to permit production from more than one production stratum or zone. Such multiple zone completions are often carried out by running two or more strings of production casing in a side-by-side relationship into a single well bore which penetrates all the zones of interest. Depending upon the design of the particular well, a completion may be a "cased" completion wherein the strings of production casing are themselves contained within a larger diameter casing installed in the borehole, or a completion may be an "open hole" completion wherein the production casing is cemented directly into an uncased well bore. Especially in open hole completions, it is important that the multiple strings of production casing be positioned away from the sides of the borehole to allow the ready circulation of cement between the casing and borehole walls. This allows good cement adhesion and thickness so that a satisfactory seal can be achieved at each production zone. Production casing is generally positioned by the use of so-called "centralizer" devices. A typical centralizer comprises a pair of longitudinally spaced-apart retaining clamps which are attached around the exterior of the casing string and connected to one another by a set of longitudinally oriented "bow spring" straps which bow outward between the retaining clamps and thus serve to hold the casing string away from the walls of the borehole.

In order to produce from a particular zone, a tool known as a perforator is lowered into one of the strings of casing and positioned at the depth of the zone to be produced. The perforation is provided with explosive charges or guns which fire jets or bullets through the wall of the casing string and into the formation to be produced. The perforator typically used in a multiple zone completion is of the type that fires its jets or bullets in a single direction. These jets or bullets must be directed so that the other casing string or strings of the multiple zone completion will not be perforated or otherwise damaged. In this manner, each zone to be produced is perforated from a selected casing string, so that it is possible to produce each zone independently of the others. It will be appreciated that in order to do this with certainty and safety, the orientation of the perforating tool with respect to the other casing strings must be known just prior to firing.

Representative prior art solutions to the problem outlined above are U.S. Pat. No. 3,704,749 to Estes et al.; U.S. Pat. No. 3,776,323 to Spidell et al.; and U.S. Pat. No. 3,964,533 to Basham et al.

The Estes et al. patent describes a device for orienting a tool such as a perforator with respect to a ferrous body such as an adjacent casing string under the general conditions already outlined, wherein the orienting device utilizes an exciter coil producing an alternating electromagnetic field and a pair of receiver coils longitudinally spaced from the exciter coils, the disposition of the receiver coils being such that the voltages induced therein vary differentially with the angle presented by the detected ferrous body by reason of the distortion of the otherwise axially symmetric field.

The Basham et al. patent describes another orienting device in which motion is imparted to a permanent magnet assembly to generate a moving magnetic field and receiver means are provided such that measurable signals are induced therein when the magnetic field is distorted due to the presence of a ferrous anomaly. The receiver means is rotated to produce an azimuthal scan such that there are induced in the receiver means signals from which the azimuthal location of the anomaly can be determined.

The Spidell et al. patent describes yet another orienting device which comprises a source producing a narrow, laterally directed beam of radiation and a laterally directionally-sensitive radiation detector unit, adapted to receive radiation resulting from scattering of the source beam radiation in the adjacent environment. Means are provided for the rotation of the direction finder device about its longitudinal axis so that an annular portion of the surrounding medium would be scanned by the source and the detector to locate the adjacent tubing strings.

While prior art orientation devices such as those described by Estes et al. allow the correct orientation of the perforator tool with respect to the adjacent tubing string in most cases, experience with such devices has indicated that in some circumstances, for example in the proximity of large ferrous masses such as casing collars, the prior art orientation devices experience a "weak signal" failure mode wherein the overall signal produced by the orientation device becomes weak and orientation is uncertain. Alerted by the weak signal, however, a trained orientation device operator will recognize the "weak signal" failure mode and will not fire the perforator and risk damaging the adjacent tubing strings.

Of greater concern to many orientation tool operators than the readily recognizable "weak signal" failure mode is a second, less common, failure mode of prior art orientation devices, which for the purposes of this disclosure will be termed the "signal reversal" failure mode. Although the "signal reversal" failure mode occurs in only a small fraction (under 1%) of orientation jobs, it is a persistent problem which has eluded solution for over ten years. In the "signal reversal" failure mode, a seemingly strong and clear signal is received from the orientation tool which, in fact, is reversed up to 180° from the actual orientation. Because of the strong signal, the "signal reversal" failure mode is not readily recognizable to a trained orientation device operator and typically results in the device operator orienting the perforator such that it fires toward, instead of away from, adjacent tubing strings, thus damaging or destroying the adjacent strings.

While the incidence of such "signal reversal" failure mode is small, it is economically significant to the users of orientation devices, such as oil field wireline services, since when a failure occurs and tubing strings are damaged, a typical wireline service must pay for repairs to the well and such repair costs may exceed the gross profit on the job by ten times or more. Thus, while the "signal reversal" failure mode occurs only occasionally, it is economically significant. A need exists, therefore, for an orientation device that allows the correct orientation of a directionally-acting tool, such as a perforator, in a borehole having multiple casing strings with respect to adjacent casing strings, and further which is resistant to the "signal reversal" failure mode. As previously discussed, the need for such a device has existed in industry for over ten years, but such need was not met until development of the current invention.

SUMMARY OF THE INVENTION

An object of the present invention is to provide an apparatus for orienting a directional tool, such as a perforator, in a borehole, such as an oil or gas well, containing two or more casing strings in a side-by-side relationship, so as to allow the perforator to be fired in a direction selected so as to avoid damaging the other casing strings which are not desired to be perforated, and to accomplish this safely and reliably by an essentially electromagnetic means, capable of a high degree of precision, and moreover, to provide an orientation tool device which is resistant to signal reversal resulting from the presence of casing string non-uniformities such that the "signal reversal" failure mode is avoided.

Another object of the present invention is to provide a reversal-resistant orientation apparatus which, in terms of user interfaces, operates in a fashion similar to prior art orientation devices such that the amount of operator retraining required to use the reversal-resistant orientation apparatus is minimized.

Yet another object of the present invention is to provide a reversal-resistant orientation apparatus which utilizes a maximum number of components common to prior art orientation devices such that production equipment used to make prior art orientation devices can be economically converted to the production of reversal-resistant orientation apparatus in accordance with the present invention.

Still another object of the present invention is to provide a receiver array for an orientation apparatus such that existing prior art orientation devices may be economically upgraded to a reversal-resistant configuration in accordance with the present invention.

A further object of the present invention is to provide a method for the orientation of a directional tool in a borehole with respect to nearby ferromagnetic materials such as an adjacent casing string so as to avoid signal reversal by casing string non-uniformities occurring in the borehole.

Other objects of the invention will appear as the description thereof proceeds.

Accordingly, the present invention provides an orientation apparatus which is preferably and most conveniently combined with the perforating device as a single tool for lowering into the casing to be perforated. The orientation apparatus comprises an exciter coil, rotating magnet, or other electromagnetic field source which produces an alternating electromagnetic field which, in an isotropic environment is symmetrical about its axis. Spaced longitudinally from the electromagnetic field source, either above or below, but in our preferred embodiment below, is a receiver array. In the preferred embodiment, three receiver coils are disposed therein the receiver array, two of which are conveniently termed reference coils, which preferably although not necessarily are disposed coaxially with the tool and therefore with the borehole, and which are spaced apart from one another, while the third coil, which may for convenience be termed a directional coil, is disposed asymmetrically with respect to the axis of the tool, and preferably is positioned between the two reference coils. As will be described in detail below, the electromagnetic field source is energized to produce an alternating electromagnetic field and electronic circuitry is provided to detect the field-induced voltages in the reference and directional coils and to transmit orientation signals to the device operator at the surface. A motor or other rotating device is also provided to rotate the orienting apparatus together with the perforator so that a favorable orientation may be selected and achieved prior to firing the perforator.

BRIEF DESCRIPTION OF THE DRAWINGS

For a more complete understanding of the present invention, reference is now made to the following description, taken in conjunction with the accompanying drawings, in which like reference numerals identify like elements in the figures and in which:

FIG. 7 is a plot showing the signal response of a prior art orientation device and the signal response of an orientation apparatus according to the current invention as each is moved proximate to the location of a centralizer retaining clamp.

FIGS. 8A, 8B and 8C show partial views of orientation devices in accordance with the current invention and, in particular, alternative configurations of a receiver array in accordance with the current invention.

DETAILED DESCRIPTION

Figure 1:
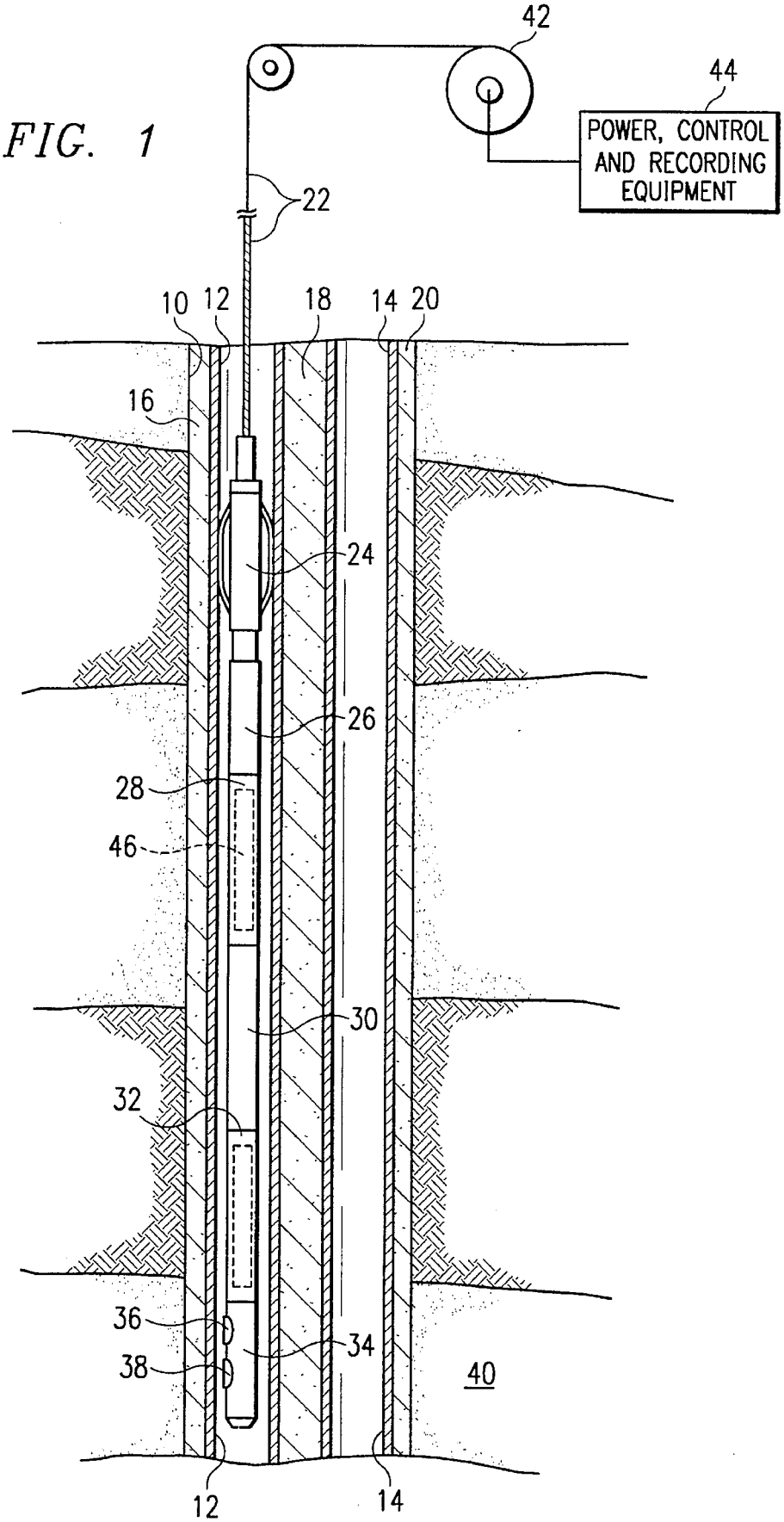
FIG. 1 is a general view, combining a schematic representation of the above-ground equipment and an enlarged view, in cross-section, of the borehole and casing strings at the depth of the orientation apparatus/perforator tool assembly.

Referring now to the drawings, wherein like reference numerals designate like or corresponding parts throughout the several views, and in particular to FIG. 1, a vertical cross section is shown of a borehole 10 which contains two casing strings, 12 and 14. Both casing strings are cemented into the borehole, sections of the cement being shown at 16, 18 and 20. An orientation apparatus 23 with perforation tool 34 attached to the lower end is suspended in the borehole by a cable 22. Orientation apparatus 23 has an overall configuration similar to that of other orientation apparatus known in the art, i.e., it comprises a drag spring section 24, which serves to maintain the selected orientation of the tool in the hole and also functions to center the tool in the casing string; a motor section 26 which serves to rotate the balance of the tool attached therebeneath in response to control signals received from the surface; an electromagnetic field source section 28; an electronics section 30; a receiver array section 32, functioning as a non-symmetrical electromagnetic field detector; and finally the directional tool 34, the orientation of which is to be adjustably controlled, and which in the typical embodiment is a perforator, two explosive charge or gun portions thereof being shown at 36 and 38. In FIG. 1, perforator 34 has been oriented so that when explosive charge or gun sections 36 and 38 are fired, the perforations will be formed in casing string 12 and the formation 40 to be produced without the jets or bullets having disturbed the integrity of the other casing string 14.

FIG. 1 also shows in schematic form hoist equipment 42 and power, control, and recording equipment 44.

Figure 2:
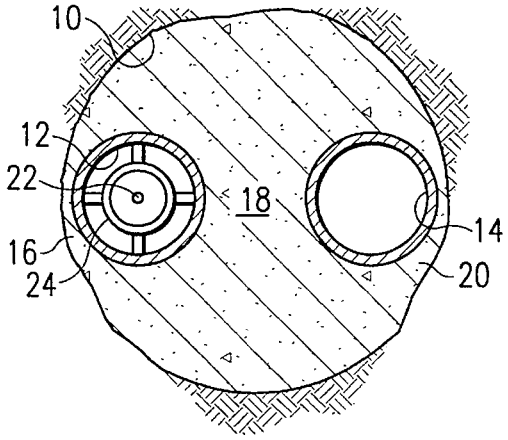
FIGS. 2 and 3 are views, in cross section, of the borehole at the approximate depth of the orientation apparatus/perforator tool assembly showing typical arrangements with respectively two casing strings and three casing strings in a single borehole.

FIG. 2 shows a cross-section taken horizontally through FIG. 1 just above the tool itself, showing the top of the drag spring section 24 in place in casing string 12, in side-by-side relationship with second casing string 14.

Figure 3:
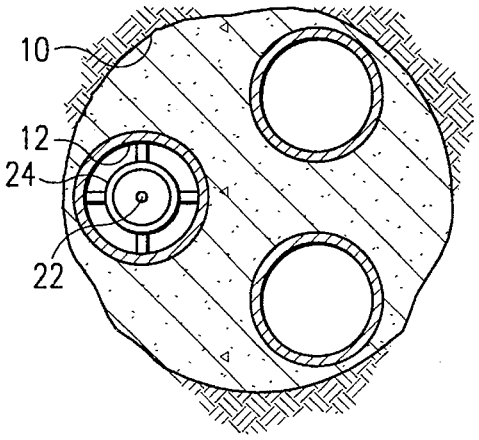

As previously mentioned, there may be numerous casing strings instead of just two, and FIG. 3 shows three such casing strings for an arrangement in all other respects essentially similar to that of FIGS. 1 and 2.

Referring once again to FIG. 1, cable 22 is of the type commonly used in wire line operations in the oil and gas industry, and thus no detailed description is required. Cable 22 comprises a steel cable strong enough to support the apparatus and has in its interior an insulated copper conductor serving to supply electrical power to the tool and also to convey the electrical signals to and from the surface.

The drag spring section 24 is shown of conventional construction, containing bow or belly springs serving primarily to maintain the orientation of the tool in the hole as it has been positioned by the operator. A secondary function is to centralize the tool in the hole.

Figure 4A:
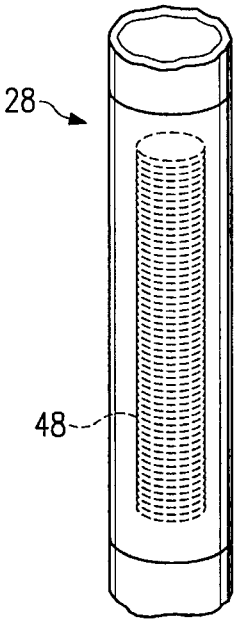
FIGS. 4A and 4B show different possible configurations for the electromagnetic field source section of the current invention.
Figure 4B:
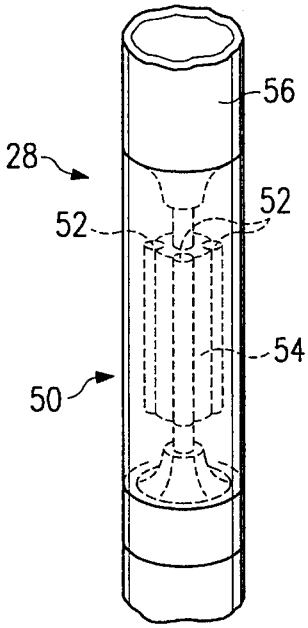

The electromagnetic field source section 28 which, as already mentioned, may be rotated at will by motor section 26, contains an electromagnetic field source 46 which, when energized, produces a detectable electromagnetic field. As shown in FIG. 4A, the electromagnetic field source may comprise an exciter coil 48 which produces an alternating electromagnetic field when energized with alternating current. Alternatively, as shown in FIG. 4B, the electromagnetic field source may comprise a permanent magnet array 50 having a plurality of permanent magnets 52 mounted in an armature 54 which is turned by motor 56 when energized. The rotation of the permanent magnets 52 in array 50 produces an alternating electromagnetic field similar to that produced by the exciter coil. Those skilled in the art will appreciate that numerous other electromagnetic field sources are within the scope of this invention. Referring again to FIG. 1, energizing electromagnetic field source 46 causes an alternating electromagnetic field to be formed in the region surrounding the source. In an isotropic environment, this field is symmetrical about the axis of the device and, accordingly symmetric about the axis of the casing string 12, by virtue of the centralizing action of the drag spring section 24. Thus, the configuration of the electromagnetic field surrounding electromagnetic field source 46 is independent of the rotation of source 46 within the casing string. However, in actual use, the medium surrounding source 46 is not isotropic, but is strongly anisotropic by reason of the presence of the additional ferromagnetic materials such as casing string 14, as shown in FIGS. 1 and 2, or indeed several such strings, as shown in FIG. 3. Thus, when electromagnetic field source 46 is energized, the electromagnetic field in the surroundings, including the casing strings, the borehole, and the surrounding formation, is severely distorted from what would otherwise be axial symmetry by the presence of the additional ferromagnetic materials. Moreover, as already mentioned, the particular configuration of the field in a given case, such as that illustrated in FIG. 1, remains essentially unchanged as motor section 26 rotates the balance of the tool including the electromagnetic field source section 28 and the receiver array section 32. The departure from symmetry occasioned by the fact that the directional tool 34 may have some asymmetrical explosive charge or gun portions 36 and 38 is negligible.

Figure 5:
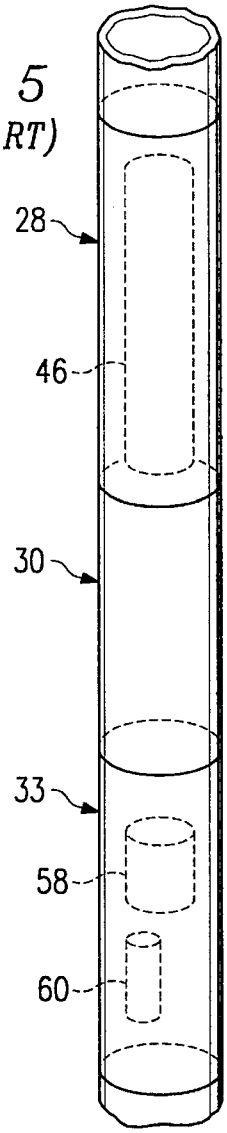
FIG. 5 (PRIOR ART)
FIG. 5 shows a partial view of a prior art orientation device and, in particular, a typical configuration of the receiver array in such a prior art device.

Coming now to the receiver array section, a key improvement of the current invention will be described. In a prior art orientation apparatus, as represented in FIG. 5, the receiver array section 33 typically comprises two receiver or pickup coils, namely, a reference coil 58, which is generally mounted symmetrically with respect to the electromagnetic field source 46 along the central axis of the orientation apparatus, and a direction coil 60, which is generally mounted asymmetrically with respect to the electromagnetic field source 46 in any one of numerous configurations known in the art. Receiver coils 58 and 60 are characterized by the fact that, first, both coils 58 and 60 act as pickup coils, i.e., they produce an induced voltage in response to the alternating electromagnetic field produced by the electromagnetic field source 46; second, that under completely isotropic conditions, that is, in the absence of any ferromagnetic material such as a second casing string 14 (depicted in FIG. 1) which would cause the electromagnetic field produced by electromagnetic field source 46 to depart from axial symmetry, the voltage induced in each coil 58 and 60 is independent of rotation of the pair of coils about the axis of the device; third, that in the presence of a distorting ferromagnetic element such as an adjacent second casing string 14 (depicted in FIG. 1), the ratio of the induced voltages produced in the two coils 58 and 60 of any given configuration will change as the device is rotated about its axis. Note that, although the voltages induced in the receiver coils 58 and 60 are subject to considerable overall variation, both in amplitude and phase, as caused for example by varying casing diameter, casing wall thickness, proximity to casing collars, and the like, these overall variations do not cause difficulty in detecting asymmetric changes in the electromagnetic field because the sensing circuitry of electronics section 30 utilizes the ratio of the voltages induced in the two receiver coils 58 and 60, not the absolute voltages themselves, to detect asymmetric variations in the electromagnetic field as the receiver array section 33 is rotated. In such prior art receiver arrays, it was known to make the receiver coils 58 and 60 on a core approximately 1 to 2 inches (25.4 to 50.8 mm.) in length because the low power rating of such coils allowed them to perform effectively when constructed using many turns of fine wire, and the short length allowed design freedom with respect to positioning the coils 58 and 60 within the confines of the receiver array section 33.

The sensing circuitry transmits to the surface signals corresponding to variations in the magnetic field. The operator at the surface can then form a registration of the receiver array with respect to ferrous elements, such as an adjacent casing string, by rotating the receiver array. Using this registration, the operator can then orient the perforator or directional tool into a preselected position with respect to the ferrous element. The perforator can then be actuated, and will typically give the desired result.

Such prior art orientation devices having receiver arrays comprising a reference coil 58 and a direction coil 60 are, as previously discussed, effective in detecting adjacent casing strings under many circumstances. Such prior art devices remain, however, vulnerable to the "signal reversal" failure mode previously described. Because of the economic impact of failures caused by the "signal reversal" failure mode, a process of extensive investigation and experimentation was conducted which finally resulted in identifying the cause of the "signal reversal" failure mode. Using this knowledge, the current invention has been developed which provides an orientation apparatus which is not subject to "signal reversal" failure mode but otherwise functions like conventional orientation devices.

To best describe the improvement embodied in the current invention, the established cause of "signal reversal" failure mode must first be described.

Figure 6A:
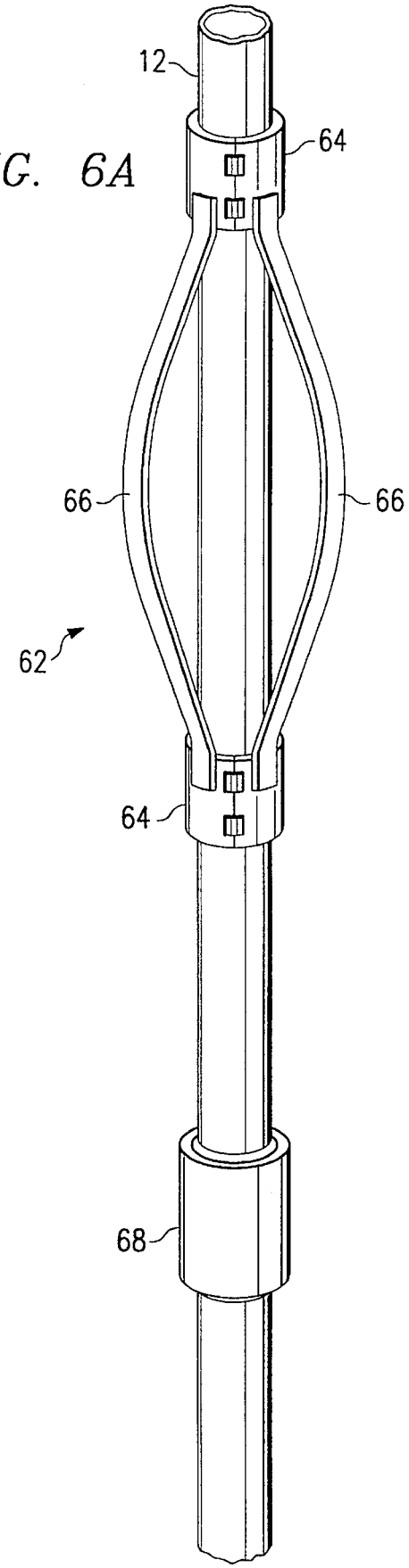
FIG. 6A is a perspective view showing the exterior of a section of casing string with a centralizer attached thereto, and further showing a casing collar.
Figure 6B:
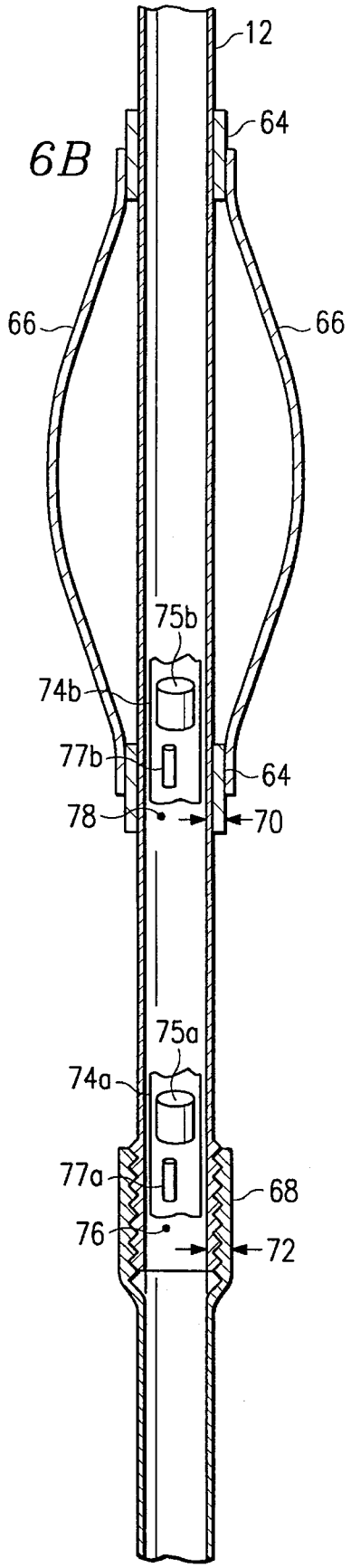
FIG. 6B is a view, in cross-section, of the casing string of FIG. 6A.

FIGS. 6A and 6B show, respectively, a perspective view and a cross section view of casing string 12 which has been removed from the borehole for clarity. Attached to casing string 12 is a typical centralizer 62 comprising retaining clamps 64 and bow springs 66. Also shown is collar 68 which serves to connect adjacent joints of casing string 12.

Now, it is known that alternating current magnetic field strength may be measured by an iron core coil, such as the reference coil of an orientation tool. Such a coil produces an induced voltage which is proportional to the difference in magnetic field strength present at each end of the core. It is also known that, for any uniform medium, whether vacuum, rock, metal, or another material, an alternating current magnetic field's strength decreases, or attenuates, as the distance from the field's source increases. Thus, in a typical orientation tool, where the electromagnetic field source is positioned above the vertically aligned reference coil, the magnetic field strength at the upper end of the reference coil will be higher than the magnetic field strength at the lower end of the reference coil because of the relative proximity of the upper end of the coil to the magnetic field source, provided, however, that the core is surrounded by uniform media. Further, it is known that if magnetic field strength is measured in decibels (db), the field strength is attenuated linearly by distance from the source or by the depth of uniform media penetrated.

Figure 9:
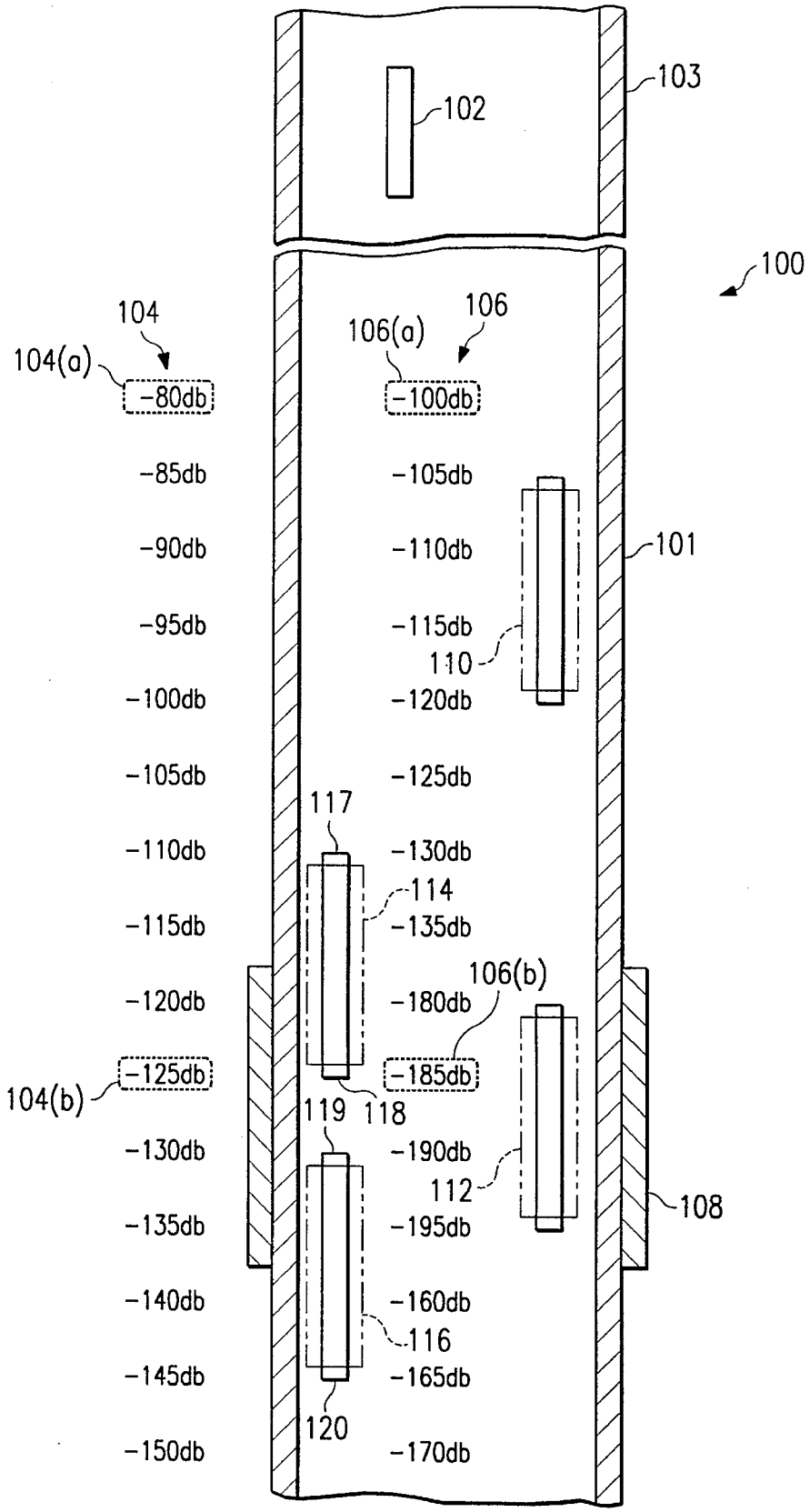
FIG. 9 is a view, in cross section, of a casing string with centralizer clamp showing the magnetic field strength inside and outside the casing string at various distances from a magnetic field source.

By way of example, referring now to FIG. 9, a casing string 100 is shown having side wall 101 and a centralizer clamp 108 attached thereto. A magnetic field source 102 is located within an upper region 103 of casing string 100 at a distance above centralizer clamp 108. First values (shown generally as 104) for the relative strength in decibels of the magnetic field (produced by source 102) in the media outside casing string 100 are given at various distances below source 102. Second values (shown generally as 106) for the relative strength in decibels of the same magnetic field (produced by source 102) inside casing string 100 are given at distances below source 102 comparable to the distances for first values 104. In this example, if the metal wall 101 of casing string 100 produces a magnetic field strength attenuation of approximately 20 db, then when first outside strength 104(*a*), located outside side wall 101, has a value of −80 db, first inside strength 106(*a*), located inside casing string 100 at a comparable distance from source 102, will have a value of −100 db as shown. Similarly, if the extra thickness of centralizer clamp 108 increases the magnetic field strength attenuation by an additional 20 db, then when second outside strength 104(*b*), located outside casing string 100 and centralizer 108, has a value of −125 db, second inside strength 106(*b*), located inside casing string 100 and centralizer 108, will have a value of −185 db.

A reference coil 110 (shown in phantom), located inside a uniform section of casing string 100 as shown, would indicate a magnetic field strength proportional to the difference in strength from its upper end to its lower end, in this case, about 15 db. Similarly, a reference coil 112 (shown in phantom), located completely inside centralizer clamp 108 as shown (or similarly, inside a casing collar) would indicate a magnetic field strength proportional to the difference in strength from its upper end to its lower end, in this case, about 15 db. Thus, an orientation tool will work reliably in pipe that is as thick as casing collars as long as the thickness over the tool is uniform. It is only where there is an abrupt change of thickness over the reference coil, that a problem occurs.

When a conventional orientation tool encounters a casing string non-uniformity such as a centralizer clamp or casing collar, there are approximately three inches of reduced signal and three inches of increased signal, separated by the length of the collar or centralizer band. This area of increased signal may contain a zone of reversed signal within the range of about one quarter inch to about three inches. Referring now to FIG. 7, an example of signal reversal is shown by Line A, which gives the results of a test in which an orientation tool with a prior art-type receiver array was moved through a section of one of two adjacent casing strings under controlled conditions which insured that the actual orientation of the tool did not change. The section of casing string through which the orientation tool was moved had a centralizer attached. An acceptable signal for such a tool is generally at least 300 to 500 counts. Despite the fixed orientation of the tool, Line A shows that, as the tool was moved through the string near the centralizer, the orientation-indicating signal started at approximately 400 counts in the region of position 0 inches, decreased to a low of approximately +100 counts in the region of position 4 inches, increased to a local high of approximately +400 counts in the region of position 5.5 inches, rapidly "reversed" to approximately −1800 counts (i.e., having a magnitude of 1800 counts but a negative direction) in the region of position 6.5 inches to 7.5 inches, then returned to another local high of approximately +1000 counts in the region of position 9.5 inches, finally returning to a steady signal of approximately 400 counts in the region past position 10 inches. Under actual conditions, the very high reversed signal in the region of position 6.5 to 7.5 inches would have indicated to an orientation tool operator that the adjacent casing string was in the opposite direction from it actual position. Thus, a cause of "signal reversal" failure mode has been identified as the effect of casing string non-uniformities such as centralizer retaining clamps.

Referring once again to FIG. 9, the cause of the increased signal, decreased signal, and signal reversal can be described. A reference coil 114 (shown in phantom), located with upper end 117 inside casing string 100 but outside centralizer clamp 108 and with lower end 118 inside both casing string 100 and centralizer clamp 108, would indicate a magnetic field strength proportional to the difference in strength from its upper end to its lower end, in this case, about 55 db. This increased indicated strength is due to the magnetic field attenuation of centralizer 108 which augments the difference between the field strengths at each end of coil 114 above the difference due to distance alone. Since an orientation tool produces an orientation signal based on the ratio of the signals from the directional coil and the reference coil, an increased reference coil signal caused by the presence of a casing string non-uniformity that is localized near the reference coil, such as in the case of coil 114, and thus does not affect the direction coil (not shown), would result in a reduced orientation signal. On the other hand, a reference coil 116 (shown in phantom), located with upper end 119 inside casing string 100 and centralizer clamp 108 and with lower end 120 inside casing string 100 but outside centralizer clamp 108, would indicate a magnetic field strength proportional to the difference in strength from its upper end to its lower end, in this case, about −25 db. This indicated negative (reversed) magnetic strength is due to the magnetic field attenuation of centralizer 108 which attenuates the field strength at upper end 119 an amount greater than the total difference in field strength between ends 119 and 120 due to distance alone. Since an orientation tool produces an orientation signal based on the ratio of the signals from the directional coil and the reference coil, a negative reference coil signal caused by the presence of a casing string non-uniformity that is localized near the reference coil, such as in the case of coil 116, and thus does not affect the direction coil (not shown), would result in a reversed orientation signal. Summarizing this example, reference coil 114, located partially above centralizer 108, would indicate a 55 db magnetic strength signal resulting in a relatively reduced orientation signal. Reference coil 112, located entirely within centralizer 108, would indicate a 15 db magnetic strength signal resulting in a relatively increased orientation signal. Reference coil 116, located partially below centralizer 108, would indicate a −25 db magnetic strength signal resulting in an orientation signal of average magnitude, but one that is reversed 180° from the true orientation.

Casing collars are easily located. Their position is precisely known. A casing collar locator is typically used with every cased hole tool string. Orientation tool operators know that orientations performed with the reference coil section in a casing collar will produce bad results, thus such situations are avoided. Casing collar locators will not, however, locate centralizers.

Centralizers, being substantially less massive than casing collars, are very difficult to locate with equipment included on a typical cased hole tool string, therefore they present an entirely different situation to the orientation tool operator. The exact position of centralizers on the casing string is typically not known, although they are nearly certain to be found in production zones. Orientations performed with the reference coil section located in a centralizer clamp will likely produce a reduced orientation signal and when the operator tries to move the tool up or down to get a better pattern, i.e., increase the signal, he may be lured to the increased signal area that contains the reversed pattern.

Having determined that "signal reversal" failure mode is associated with the very localized effect of casing string non-uniformities on the coils of the receiver array section, the current invention produces an improved orientation tool resistant to "signal reversal" failure mode by providing a reference coil assembly that is configured such that it cannot be encompassed by typically encountered casing string non-uniformities such as centralizer clamps. Apart from the new receiver array section, the remainder of the improved orientation tool has a conventional configuration similar to prior art orientation tools.

Referring now to FIGS. 8*a*, 8*b*, and 8*c*, a receiver array section 32 in accordance with the improved orientation tool of the current invention can be described. Knowing that the commonly encountered casing string non-uniformities have a linear extent (measured along the longitudinal axis of the borehole) of approximately 1 to 4 inches (25.4 to 101.6 mm), the reference coil assembly of the current invention is configured such that it cannot be physically encompassed by a localized casing string non-uniformity. Referring still to FIGS. 8*a*, 8*b*, and 8*c*, a portion of the improved orientation apparatus of the current invention is shown including the electromagnetic field source section 28, electromagnetic field source 46, electronics section 30 containing, among other things, electronic signal processing circuitry, and receiver array section 32. Receiver array section 32 comprises reference coil assembly 82, which is configured to avoid reversal by localized casing string non-uniformities, and direction coil 88, which may be configured in a variety of ways as known to those skilled in the art.

Referring now specifically to FIG. 8*a*, the preferred embodiment of the current invention is shown, wherein reference coil assembly 82*a* comprises first and second reference coils 84*a* and 86*a*, respectively, which are generally positioned along the longitudinal centerline of the orientation apparatus, one coil on each side of direction coil 88*a*. First reference coil 84*a* has an outside end 85*a* and an inside end 89*a*, while second reference coil 86*a*has an outside end 87*a* and an inside end 91*a*. In this preferred embodiment, the total distance 93*a* spanned between outside ends 85*a* and 87*a* is within the range of about 4 inches to about 14 inches. In a more preferred embodiment, the total distance 93*a* spanned is within the range of about 7 inches to about 12 inches. Reference coils 84*a* and 86*a* may be electrically connected to the associated sensing circuitry of the orientation apparatus in a variety of ways. In the preferred embodiment, each reference coil 84*a* and 86*a* is connected to the circuitry in electronics section 30 such that its induced voltage can be sampled and compared to the induced voltage of the direction coil 88*a* independently of the other reference coil. Circuitry in electronics section 30 can be provided to allow the continuous switching between reference coils and comparison of signals resulting therefrom so that the casing string non-uniformities can be recognized by the orientation apparatus operator, and "signal reversal" failure mode thus avoided.

In alternative embodiments, reference coil 84*a* and 86*a* are electrically connected in series to the circuitry of electronics section 30 such that a composite induced voltage is produced. Although such series connection of reference coils 84*a* and 86*a* does not allow the apparatus operator to readily identify casing string non-uniformities, it nonetheless prevents "signal reversal" failure mode.

Referring again to FIG. 7, Line B shows the results of a test in which an orientation tool in accordance with the current invention, having a two-reference-coil, series-connected receiver array of the alternative embodiment just described, was passed through the annular area of a centralizer under the same controlled conditions previously described in the test of prior art-type apparatus. As shown by Line B, the orientation tool in accordance with the current invention produced an orientation signal of approximately +300 counts or more as it passed through the region of the centralizer clamp. The tool did not experience "signal reversal" failure mode in the region of position 6.5 to 7.5 inches under the same conditions which caused severe "signal reversal" failure in the prior art-style apparatus.

Those skilled in the art will appreciate that the current invention encompasses additional embodiments wherein reference coil 84*a* or 86*a* each comprise two or more discrete reference coils instead of just one, provided the alternative configuration spanned the previously disclosed distances as necessary to avoid reversal by casing string non-uniformities.

Referring now to FIG. 8*b*, another alternative embodiment of the current invention is shown. In this embodiment, reference coil assembly 82*b* comprises first and second reference coils 84*b* and 86*b*, respectively, which are positioned together generally along the longitudinal centerline of the orientation apparatus on the same side of direction coil 88*b*. First reference coil 84*b* has an outside end 85*b* and an inside end 89*b*, while second reference coil 86*b* has a outside end 87*b* and an inside end 91*b*. In this alternative embodiment, the total distance 93*b* spanned between outside ends 85*b* and 87*b* is within the range of about 4 inches to about 14 inches. In a more preferred embodiment, the total distance 93*b* spanned is within the range of about 7 inches to about 12 inches. As with the previously discussed embodiment of FIG. 8*a*, reference coils 84*b* and 86*b* can be electrically connected to the circuitry of electronics section 30 in a variety of ways including independently switched and series connections. Those skilled in the art will appreciate that the current invention encompasses additional embodiments wherein reference coil assembly 82*b* could be positioned below, rather than above, direction coil 88*b* as represented here, or alternatively, where reference coil assembly 82*b* comprises three or more reference coils instead of two, provided the configuration spanned the previously disclosed distances as necessary to avoid reversal by casing string non-uniformities.

Referring now to FIG. 8*c*, yet another alternative embodiment of the current invention is shown. In this embodiment, reference coil assembly 82*c* comprises an oversized reference coil 90 which is positioned along the centerline of the orientation apparatus above direction coil 88*c*. Reference coil 90 has a first end 94 and a second end 96 such that overall span 93c, i.e., the distance between first and second ends 94 and 96, respectively, is within the range of about 4 inches to about 14 inches. In a more preferred embodiment, reference coil 90 has an overall span 93*c* within the range of about 7 inches to about 12 inches. Reference coil 90 may be electrically connected in a manner similar to conventional reference coils. Those skilled in the art will appreciate that the current invention encompasses additional embodiments wherein reference coil assembly 82*c* could be positioned below, rather than above, direction coil 88*c* as represented here, provided the configuration spanned the previously disclosed distances as necessary to avoid reversal by casing string non-uniformities.

Returning to the overall view as shown in FIG. 1, we find the arrangement of the electrical circuits in motor section 26, electromagnetic field source section 28, electronics section 30, receiver array section 32, and directional tool or perforator 34, so as to allow selective activation, sensing and control of the orientation apparatus is conventional and well known in the art so that it need not be described in detail here.

Reverting now to our invention broadly, it will be seen that it accomplishes the objective of providing an improved orientation apparatus that is resistant to "signal reversal" failure mode of prior art apparatus. An orientation apparatus in accordance with the current invention further accomplishes the objective that, in terms of user interface, it functions identically to prior art devices such that minimal operator re-training is required to utilize the current invention and realize the full advantages of its improvements. It should also be mentioned that orientation apparatus in accordance with the current invention utilize a maximum number of components common to the prior art orientation devices such that equipment used for the production of prior art orientation devices can be economically converted to production of reversal-resistant apparatus in accordance with the present invention. The present invention also provides a method for the orientation of a perforator or other directional tool with respect to a ferrous mass such that "signal reversal" failure mode is avoided.

We wish it to be understood that we do not desire to be limited to the exact details of construction shown and described, for obvious modifications will occur to a person skilled in the art.

I claim:

1. A device for subsurface emplacement in a borehole adjacent to a ferrous element for determining the orientation of said element with respect to said device comprising:

a) an electromagnetic field source producing an electromagnetic field in the region surrounding said source, said field having axial symmetry in the absence of said element but having axial asymmetry in the presence of said element;

b) a receiver array including a reference coil assembly and a directional coil;

said reference coil assembly longitudinally spaced from said electromagnetic field source and adapted for the production of an induced voltage from said field, said reference coil assembly further adapted to avoid signal reversal by a localized non-uniformity in said ferrous element;

said direction coil positioned adjacent said reference coil assembly and likewise adapted for the production of an induced voltage from said field, said direction coil being positioned non-symmetrically with respect to the longitudinal axis of said electromagnetic field source;

c) a motor section for rotating said device in said borehole; and d) sensing circuitry for determining the ratio of said induced voltage in said direction coil to said induced voltage from said reference coil assembly as a function of the angular orientation of said device with respect to said ferrous element.

2. The device of claim 1 wherein said reference coil assembly further comprises:

first and second reference coils positioned longitudinally on opposite sides of said direction coil;

each said reference coil having an inside end and an outside end and being adapted to produce an induced voltage from said field;

said inside ends of said reference coils being those ends closest to said direction coil; and said outside ends being those ends farthest from said direction coil.

3. The device of claim 2 wherein said first and second reference coils are electrically connected in series.

4. The device of claim 2 wherein said first and second reference coils are electrically connected to said sensing circuitry such that said induced voltage of each reference coil can be independently sampled.

5. The device of claim 2, wherein a distance between said outside ends of said first and second reference coils is within the range of about 4 inches to about 14 inches.

6. The device of claim 5, wherein said distance between said outside ends of said first and second reference coils is within the range of about 7 inches to about 12 inches.

7. The device of claim 1 wherein said reference coil assembly further comprises:

first and second reference coils positioned longitudinally on a same side of said direction coil;

each said reference coil adapted for the production of an induced voltage from said field and having an interior end and an exterior end;

said interior end of each said reference coil being that end closest to the other said reference coil; and said exterior end of each said reference coil being that end farthest from the other said reference coil.

8. The device of claim 7, wherein said first and second reference coils are electrically connected in series.

9. The device of claim 7, wherein said first and second reference coils are electrically connected to said sensing circuitry such that said induced voltage of each reference coil can be independently sampled.

10. The device of claim 7, wherein said first and second reference coils are further disposed such that a span between said exterior ends of said first and second reference coils is within the range of about 4 inches to about 14 inches.

11. The device of claim 10, wherein said span between said exterior ends of said first and second reference coils is within the range of about 7 inches to about 12 inches.

12. The device of claim 1 wherein said reference coil assembly further comprises a reference coil adapted for the production of an induced voltage from said field, said reference coil having a length within the range of about 4 inches to about 14 inches.

13. The device of claim 12 wherein said reference coil has a length within the range of about 7 inches to about 12 inches.

14. A receiver array for detecting an electromagnetic field in a subsurface borehole orientation apparatus having an electromagnetic field source and sensing circuitry, said receiver array comprising:

a reference coil assembly and a directional coil;

said reference coil assembly adapted to be longitudinally spaced from said electromagnetic field source, adapted to produce an induced voltage from said field, and adapted to avoid signal reversal by a localized non-uniform ferrous element; and said direction coil positioned adjacent said reference coil assembly and likewise adapted for the production of an induced voltage from said field, said direction coil being adapted to be positioned non-symmetrically with respect to the longitudinal axis of said electromagnetic field source.

15. The receiver array of claim 14 wherein said reference coil assembly further comprises first and second reference coils each adapted for the production of an induced voltage from said field, said first and second reference coils longitudinally spaced from one another and positioned on opposite sides of said direction coil.

16. The receiver array of claim 15 wherein said first and second reference coils are electrically connected in series.

17. The receiver array of claim 15 wherein said first and second reference coils are electrically connected to said sensing circuitry such that said induced voltage of each reference coil can be independently sampled.

18. The receiver array of claim 15 wherein a distance spanned by the farthest apart points of said first and second reference coils is within the range of about 4 inches to about 14 inches.

19. The receiver array of claim 14 wherein said reference coil assembly further comprises first and second reference coils each adapted for the production of an induced voltage from said field, said first and second reference coils being disposed on the same side of said direction coil.

20. The receiver array of claim 19 wherein said first and second reference coils are electrically connected in series.

21. The receiver array of claim 19 wherein said first and second reference coils are electrically connected to said sensing circuitry such that said induced voltage of each reference coil can be independently sampled.

22. The receiver array of claim 19 wherein said first and second reference coils are further disposed such that a span between farthest points on said coils is within the range of about 4 inches to about 14 inches.

23. The receiver array of claim 14 wherein said reference coil assembly further comprises a reference coil adapted for the production of an induced voltage from said field, said reference coil having a length within the range of about 4 inches to about 14 inches.

24. A method for orienting an actuatable subsurface device in a borehole containing a ferrous element, to a preselected orientation with respect to said ferrous element, said method comprising:

positioning in said borehole an electromagnetic field source, said source producing an electromagnetic field axially symmetric with said borehole under isotropic conditions but said electromagnetic field asymmetrically distorted by the presence of said ferrous element;

positioning a rotatable receiver array longitudinally spaced from said electromagnetic field source in said borehole, said receiver array producing voltages responsive to the magnitude and the configuration of said electromagnetic field, but not subject to signal reversal when proximate to a non-uniformity in said ferrous element;

positioning in said borehole sensing circuitry, said sensing circuitry receiving said voltages from said receiver array and providing an electrical signal indicative of said field configuration, transmitting said signal to said surface;

rotating said receiver array so as to cause a registration at said surface of the orientation of said receiver array with respect to said ferrous element;

rotating said subsurface actuatable device into said preselected position with respect to said ferrous element; and subsequently actuating said device.

25. The method of claim 24 wherein said receiver array comprises:

a reference coil assembly and a directional coil;

said reference coil assembly adapted to be longitudinally spaced from said electromagnetic field source, adapted to produce an induced voltage from said field, and adapted to avoid signal reversal when proximate to a non-uniformity in said ferrous element; and said direction coil positioned adjacent said reference coil assembly and likewise adapted for the production of an induced voltage from said field, said direction coil being adapted to be positioned non-symmetrically with respect to the longitudinal axis of said electromagnetic field source.

26. The method of claim 25 wherein said reference coil assembly further comprises first and second reference coils each adapted for the production of an induced voltage from said field, said first and second reference coils longitudinally spaced from one another and positioned on opposite sides of said direction coil wherein a distance spanned by the farthest apart points of said first and second reference coils is within the range of about 4 inches to about 14 inches.

27. The method of claim 26 wherein said first and second reference coils are electrically connected in series.

28. The method of claim 26 wherein said first and second reference coils are electrically connected to said sensing circuitry such that said induced voltage of each reference coil can be independently sampled.

* * * * *